United States Patent [19]

Schneider et al.

[11] Patent Number: 4,986,028

[45] Date of Patent: Jan. 22, 1991

[54] MOUNTING BRACKET

[75] Inventors: Alfred Schneider, Kreuztal; Michael Zimmerman, Siegen, both of Fed. Rep. of Germany

[73] Assignee: Siegenia-Frank KG, Siegen, Fed. Rep. of Germany

[21] Appl. No.: 533,589

[22] Filed: Jun. 5, 1990

[30] Foreign Application Priority Data

| | | | |
|---|---|---|---|
| Jun. 19, 1989 | [DE] | Fed. Rep. of Germany | 3919970 |
| Oct. 19, 1989 | [DE] | Fed. Rep. of Germany | 8912421[U] |
| Feb. 13, 1990 | [DE] | Fed. Rep. of Germany | 9001629[U] |

[51] Int. Cl.[5] ..... E05D 15/28

[52] U.S. Cl. ..... 49/248; 16/361; 16/370; 49/252

[58] Field of Search ..... 49/248, 246, 247, 249, 49/250, 251, 252, 191, 192; 16/360, 370, 361, 364

[56] References Cited

U.S. PATENT DOCUMENTS

| | | | |
|---|---|---|---|
| 1,864,164 | 6/1932 | Aldeen . | |
| 2,784,459 | 3/1957 | Anderberg et al. | 49/248 |
| 3,722,142 | 3/1973 | Anderberg . | |
| 4,414,706 | 11/1983 | Douglas | 49/248 X |
| 4,555,829 | 12/1985 | Davis | 49/250 X |
| 4,790,106 | 12/1988 | La See | 49/252 |
| 4,833,754 | 5/1989 | Yang | 49/252 |

FOREIGN PATENT DOCUMENTS

| | | |
|---|---|---|
| 272139 | 6/1969 | Austria . |
| 0204267 | 12/1986 | European Pat. Off. . |
| 0275235 | 7/1988 | European Pat. Off. . |
| 0283659 | 9/1988 | European Pat. Off. . |
| 6942006 | 10/1969 | Fed. Rep. of Germany . |
| 3600211 | 5/1987 | Fed. Rep. of Germany . |
| 3710056 | 10/1988 | Fed. Rep. of Germany . |

*Primary Examiner*—Philip C. Kannan

*Attorney, Agent, or Firm*—Gerry A. Blodgett; Norman S. Blodgett

[57] ABSTRACT

A mounting device 10 for the wings 2 of windows, doors, etc., which consists of a bearing rail 11 to be secured in the groove 1' on the frame side and a holding rail 12 which also fits into the groove on the wing side, and of two guides 6 and 7. Each of the guides 6 and 7 is connected on one side to the bearing rail 11 and on the other to the holding rail 12 such that it can move at least in a pivoting motion and is non-detachable.

Simple hinging and unhinging of the wing 2 relative to the fixed frame 1 is achieved by the fact that at least the bearing rail 11 can be connected using a plug-type connection to the bases 13 and 14 mounted on the periphery of the groove surface 1' of the fixed frame 1 in a detachable-interlocking manner 24, 25 and 26, 27 and can be secured against these bases 13 and 14 in contact position by means of a latch 26, 27".

12 Claims, 9 Drawing Sheets

MOUNTING BRACKET

The invention relates to a mounting bracket for the wings of windows, doors, etc., consisting of a bearing rail secured in a groove on the frame side, a holding rail which also fits into a groove on the wing side, and of two guides, each of which is connected on one side to the bearing rail and on the other to the holding rail in a manner which at least allows a swiveling motion, and preferably in a non-detachable manner.

Mounting brackets of this type are known, such as those presented in European Patent No. 0,204,267 and U.S. Pat. No. 3,722,142.

European Patent No. 0,204,267 presents a device in which the two guides are of different lengths and are connected to the bearing rail and holding rail via one rotary joint each, so as to form with these rails a guiding trapezoid whose shortest member is the holding rail on the wing side. U.S. Pat. No. 3,722,142 presents a device which also has two guides between the bearing rail on the frame side and the holding rail on the wing side. However, these rails are directly connected, being joined by a connecting bolt in the manner of what are referred to as "cross-shears", and they both fit into the bearing rail on the frame side at one end and the holding rail on the wing side at the other in a rotating manner. On the one hand, this makes it possible for one of the guides to fit into the bearing rail on the frame side and the holding rail on the wing side with both of its ends in such a manner that it can only be pivoted, while the other guide fits into the bearing rail and holding rail such that it can be pivoted or displaced. On the other hand, it is possible for each of the two guides to fit into the bearing rail or holding rail with one of its ends in such a manner that it can only be pivoted, while the other side is connected to the holding rail or bearing rail such that it can be pivoted or displaced, as is the case in U.S. Pat. No. 1,864,164.

When it is opened and closed, the wing not only moves with its cover away from the plane of the frame in a normal direction, it is also displaced in a translational manner in a direction parallel to the plane of the frame.

To compensate for both the defects or inaccuracies occurring in the frame when the wing is installed and the settling of the wing occurring with constant use over time, the bearing rail to be secured in the groove on the frame side is equipped with oblong holes which run longitudinally and which the fastening screws to be anchored in the frame pass through.

If it becomes necessary to correct the position of the wing in the frame, the fastening screws must be loosened so that the bearing rail can be shifted with respect to the frame as required. The fastening screws must then be tightened so that the changed position of the bearing rail with respect to the frame can be properly secured.

Aside from the fact that all of the fastening screws for the bearing rail on the frame must be loosened and then tightened again in order to adjust the position of the wing, (a relatively time-consuming procedure), this procedure is also disadvantageous, at least in the case of windows manufactured using wood or plastic forms, because the fastening screws no longer sit tightly after being loosened and tightened again several times. In the long term, this therefore impairs the proper opening and closing of the wing.

In the mounting bracket of European Patent No. 0,204,267, one of the two rotary joints of each guide, i.e., the rotary joint of the short guide on the holding rail on the wing side and that of the rotary joint of the long guide on the bearing rail on the frame side, is designed so that it may be disengaged, in order to allow for hinging and unhinging of the wing relative to the frame. In the mounting bracket device of U.S. Pat. No. 3,722,142, in contrast, the joints of the two guides are connected in a non-detachable manner, both on the bearing rail on the frame side and the holding rail on the wing side. The result is that troublesome manipulation is required in order to hinge and unhinge the wing relative to the frame, and one must also see to it that there is a corresponding holding device or support for the opened window relative to the frame.

In mounting brackets corresponding in design or function to the type presented in U.S. Pat. No. 3,722,142, it is possible to design either the two connecting joints on the wing side or the two connecting joints for the two guides on the frame side so that they can be disengaged, as is the case in European Patent No. 0,204,267. However, practical experiments have shown that difficulties arise in both cases, particularly in the process of placing the wing on its hinges. This is because the distances between the free pivot pins of the two guides and the distances between the corresponding contact openings which form the rotary joint and the sliding joint and the bearing rail or holding rail are not in a fixed relationship to each other.

It is, therefore, extremely difficult to reconnect the disengaged joint sites when the window is placed on its hinges. While the window is being placed on its hinges, the functional parts of the rotary joint and the functional parts of the sliding joint must be precisely aligned with each other.

The purpose of the invention is to eliminate the aforementioned drawbacks of mounting brackets of the conventional type. For this reason, the main object of the invention is to provide a mounting bracket of the type specified above for the wings of windows, doors, etc., in which it is possible to hinge and unhinge the wings on the fixed frame in a simple and secure manner while guaranteeing that the wings can be opened and closed in a secure manner for a lasting period of time.

However, the invention also serves the purpose of providing a mounting bracket of the type specified above which allows for adjustment of the position of the wing relative to the fixed frame, without requiring that the fastening screws which attach the holding rail to the fixed frame and/or the bearing rail to the wing be loosened and tightened again.

Finally, the invention also aims to improve on known mounting brackets such that position adjustment of the wing in relation to the fixed frame can be carried out in a normal direction relative to the closing plane without requiring significant additional technical effort, thus achieving displacement of the wing for closing thrust relative to the fixed frame.

The main purpose of the invention is achieved by the fact that at least the bearing rail can be connected using a plug-type connection to bases mounted on the groove surface of the fixed frame in a detachable-interlocking manner and can be locked against these bases in its contact position.

The advantage of this solution is that the bases can be premounted on the groove surface of the fixed frame completely independently from the mounting bracket, i.e., by using a special placement gauge, which makes it possible to bring the bearing rails which constitute an essential part of the functional mounting bracket into or out of contact with these bases on the fixed frame at any time.

It has proven to be particularly favorable in this invention if at least each end of the bearing rail has a base mounted on the groove surface of the fixed frame, because under that circumstance the precise alignment of the bearing rail on the fixed frame required for opening and closing the wing without problems can be assured.

If, according to the invention, one of the bases has an angled shape and is mounted in a corner area of the peripheral surface of the frame, the mounting of the bearing rail will be particularly favorable, because one angle leg fits closely onto one frame leg each, thus fixing the base in a secure manner.

Stability and functionality of the mounting bracket can also be optimized by the method of the invention if the bearing rails have a flattened U-shaped cross-section and fit around the longitudinal edges of the bases with the so-formed U-legs, if the end of the bearing rail has a laterally offset tongue with which it can be engaged or inserted in an opening provided on one of the bases, and if the bearing rail can be secured to the other base at least in the vicinity of its other end by means of an adjustable latch.

It has also proven to be particularly advantageous if the adjustable latch has a rotating toggle which can be stiffly moved on the second base and an accompanying contact opening in the web of the bearing rail. The rotating toggle can be designed so that in its operating position, it not only overlaps the edge of the contact opening, but also exerts a compressive force longitudinally to the bearing rail which acts in the direction in which the tongue is inserted into the opening provided in the other base, i.e., by means of corresponding eccentricity of its bearing shaft.

In many cases it has also been found to be advantageous if the two bases in the invention are connected by a transition piece at a predetermined distance, preferably in a single piece. This not only ensures that the precise distance between the two bases will be maintained, but also simplifies their installation on the peripheral surface of the groove surface of the fixed frame. Moreover, this also allows the dimensional stability of the bearing rail to be improved, because this rail then fits with its U-leg around not only the two bases but also around the transition piece. This design is particularly appropriate for windows and doors which are manufactured from plastic or metal shapes because the bases and the transition piece connecting them can be precisely adapted to the shape in question, taking account of their cross-sectional form, while the bearing rail can have the same form in all cases.

Finally, an additional feature of the invention is that the bases and bearing rail can be attached to the fixed frame and to each other using screws, in such a manner that even wings of heavy weights up to 130 kg can be safely placed in the fixed frame.

The design for mounting brackets of the present invention can be used for windows and doors whose wings can be opened by rotating, tipping, or tilting in relation to the fixed frame. In such cases, mounting brackets of the same type operate together in the manner of multi-joint hinges. However, the mounting bracket of the invention should preferably be used in windows and doors with rotary/tilting wings. In such cases, the mounting bracket, which is horizontally installed below, acts as a rotary/tilting corner bearing. In the place of the holding rail on the side of the wing, the mounting bracket vertically installed above has a mounting arm. This can be coupled to the wing in a parallel position for closing and rotary opening of the window by means of a driving rod brace built into the wing. It can be released with respect to the wing when it is tipped open in order to allow for a limited slanting position. The slanting position of the mounting arm is limited because on the one hand, its free end acts upon the window over a limited range of motion in a swiveling/sliding manner, and on the other hand, it operates together with an additional arm to form a so-called "ellipse guide" which is coupled to both the mounting arm and the wing. Thus, it can only be moved in a swiveling manner.

The additional purpose of the invention is achieved in a particularly simple manner by the fact that the guide (which can otherwise only be moved in a swiveling manner) is positioned with at least one of its limbs on a slide which is supported against the bearing rail or holding rail by means of an adjusting member in such a manner that it can be laterally displaced to a limited degree.

As an improvement on the mounting device of the invention, the adjusting member may consist of a thread element which on the one hand is supported against the bearing rail or holding rail such that it can be rotated but not displaced and on the other hand fits into a counterthread located in the slide.

According to a further aspect of the invention, a cam may also be used as the adjusting member. This cam maybe located in the slide, such that it can be rotated stiffly, and with the cam permanently fitting into an oblong hole located in the bearing or holding rail, whose length is perpendicular to the direction of movement of the slide.

Of course, it is also within the scope of the invention to allow the two joints of the guide which can otherwise move only in a pivoting manner, to operate together with one slide each and an adjusting member which comes into contact with the slide, in which case one of the slides has the accompanying adjustment member of the holding rail on the frame side and the other slide has the accompanying adjustment member of the bearing rail on the wing side.

Thus the design of the mounting bracket device of the present invention can be used on windows and doors whose wings can be opened by turning, tipping, or tilting with respect to the frame. In such cases, the two mounting brackets of the same type operate together in the manner of multi-joint hinges.

However, the mounting bracket of the invention should preferably be used in windows and doors with rotary/tilting wings. In this case, the mounting bracket, which is horizontally installed below, acts as a rotary/-tilting corner bearing. In the place of the holding rail on the side of the wing, the mounting bracket vertically installed above has a mounting arm which can be coupled to the wing in a parallel position for closing and rotary opening of the window by means of a driving rod brace built into the wing, while it can be released with respect to the wing when it is tipped open in order to allow for a limited slanting position. The slanting position of the mounting arm is limited because, on the one hand, its free end acts upon the window over a limited range of motion in a swiveling/sliding manner, and on the other hand, it operates together with an additional arm to form a so-called "ellipse guide" which is coupled to both the mounting arm and the wing such that it can only be moved in a swiveling manner.

The object of the invention can be achieved in a particularly advantageous manner with mounting brackets in which at least the bearing rail can be connected using a plug-type connection to bases mounted on the groove surface of the fixed frame in a detachable-interlocking manner and which can be locked against these bases in its contact position. In this case, another innovative characteristic is that the slide is placed or taken up in a free space which is separated from the sites at which the base and bearing rail are attached.

According to the invention, it is also advantageous if the free space of the bearing rail corresponds to a free space in the base and the slide is between the two free spaces.

The invention solves the aforementioned problem by the fact that the guide which can otherwise be moved in a pivoting manner only, comes into contact with the holding rail or bearing rail by its second joint, in such a manner that it can be transversely adjusted.

It is particularly simple and advantageous if the joint according to the invention consists of a cam peg which is connected to the guide such that it can be stiffly rotated and can be connected using a plug-type connection in a detachable manner using a bearing bushing located on the bearing rail on the wing side.

An additional aspect of the invention is that the cam peg has a band below the bearing bush which has tool contact surfaces for a tool (such as a wrench) on its periphery, and the cam peg is press-fit or riveted to the guide.

These objects of the invention and its advantages are explained in the following using the practical examples shown in the figures. Further objects and aspects of the invention will become apparent as specific embodiments are described.

BRIEF DESCRIPTION OF THE DRAWINGS

Inventive aspects of the mounting bracket of the present invention may be best understood by reference to specific embodiments as shown in the drawings, which are illustrative and not limiting.

DETAILED DESCRIPTION OF THE PREFERRED EMBODIMENT

Figures 1, 2, 3, 4:
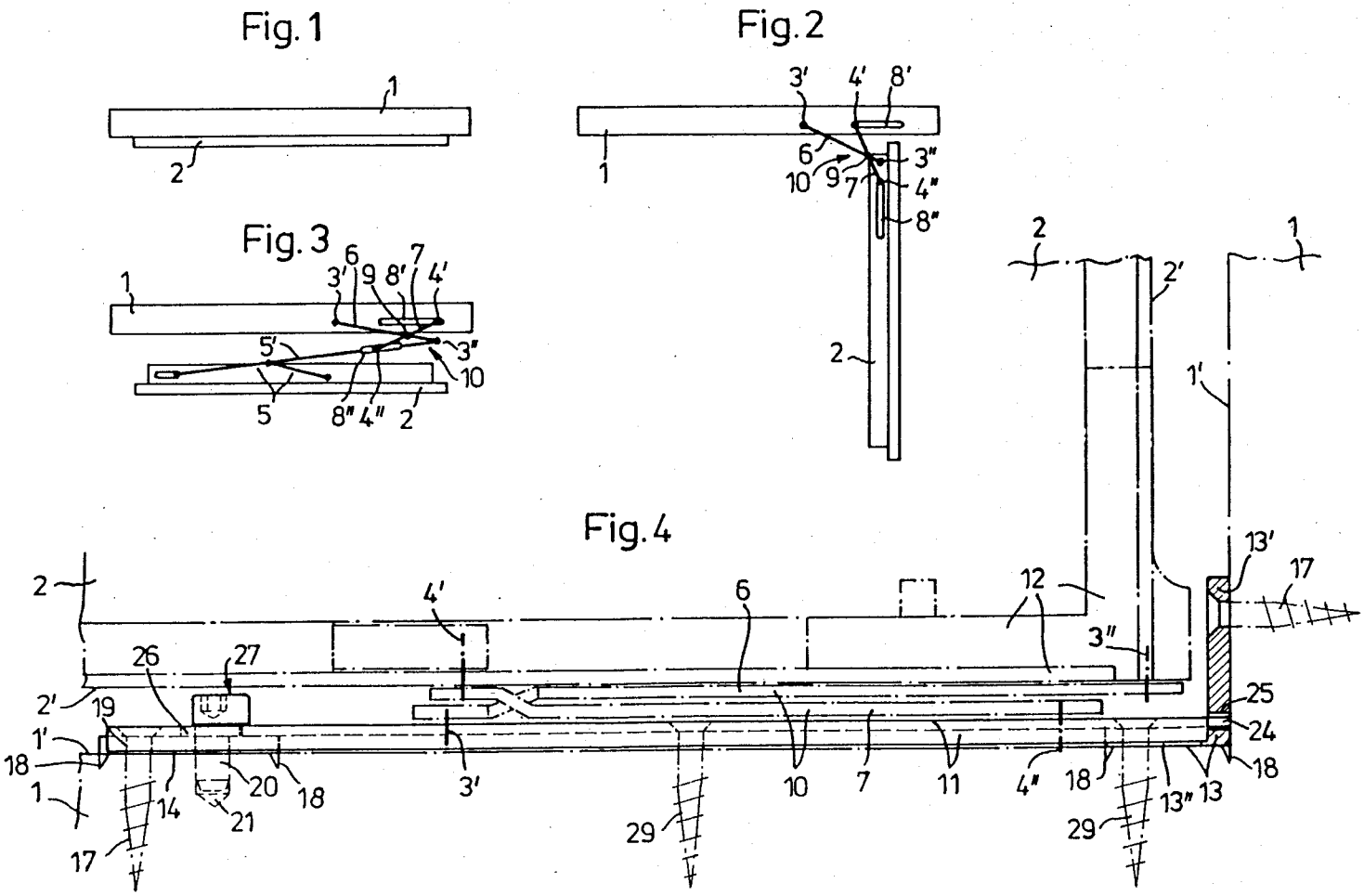
FIG. 1 is a schematically simplified top view of a window whose wing is adjacent to the fixed frame when it is in the closed position.
FIG. 2 is a schematically simplified top view of a window with its wing opened in a rotary position relative to the fixed frame.
FIG. 3 is a schematically simplified top view of a window with its wing opened in a tilted position relative to the fixed frame.
FIG. 4 is a front view and partial vertical section of a mounting bracket, used in wings which close onto the fixed frame, which is installed as a rotary/tilting corner bearing in rotary/tilting windows or doors or as a hinge for rotary wing windows.

FIG. 1 of the drawing shows a schematic depiction of a window or glass door in which the wing 2 is closed in a position adjacent to the fixed frame 1. FIG. 2 of the drawing shows the same window or glass door, in which the wing 2 is rotated open relative to the fixed frame 1 by means of joints 3',3" and 4', 4" which are parallel to its vertical side edge. Finally, FIG. 3 of the drawing shows that the window or glass door can also be designed as a rotary/tilting window or door, in which the wing 2 can been seen in its tilted open position relative to the fixed frame 1 and the degree to which it can be opened is limited by a rotary/tilting mounting bracket 5 which is installed between the upper horizontal spars of the fixed frame 1 and the wing 2. In this case as well, the mounting bracket 5 operates via joints 3', 3" and 4', 4" together with the fixed frame 1, while the rotary tilting corner bearing corresponds in its dynamic structure to the arrangement shown in FIG. 2. The joints 3', 3" and 4', 4" thus show the same arrangement and design both in the area of the upper horizontal grooves and in the area of the lower horizontal groove between the fixed frame 1 and the wing 2. Specifically, the axes of these joints 3', 3" and 4', 4" are parallel to the vertical limiting edges of the fixed frame 1 and wing 2.

The joints 3' and 3" are located at either end of a guide 6, with the joint 3' fitting into the fixed frame 1 only in a pivoting manner and the joint 3" fitting into the wing 2 also in an exclusively pivoting manner. The joints 4' and 4" are located on the ends of a second guide 7, with the joint 4' fitting into a sliding slot 8' aligned parallel to the plane of the fixed frame 1, while joint 4" fits into a sliding slot 8" in a corresponding manner, which slot is located on wing 2 parallel to this plane. Thus sliding joint 4'/8' is formed on the fixed frame 1 and sliding joint 4"/8" is formed on the wing.

The two guides 6 and 7 are constantly connected to each other by means of a rotary joint 9 in the manner of cross-shears. The common joint 9 of the two guides 6 and 7 should preferably be at a smaller distance from joint 3" than from joint 3' on guide 6 and at a smaller distance from joint ' than from 4" on guide 7.

It is apparent that rotary joint 3' and the sliding joint 4'/8' on the fixed frame 1 (on the one hand) and rotary joint 3" and the sliding joint 4"/8" on wing 2 (on the other) must constantly be in precisely coordinated positions with respect to each other in order to guarantee the proper functional mobility of the wing 2 with respect to the fixed frame 1.

Figure 5:
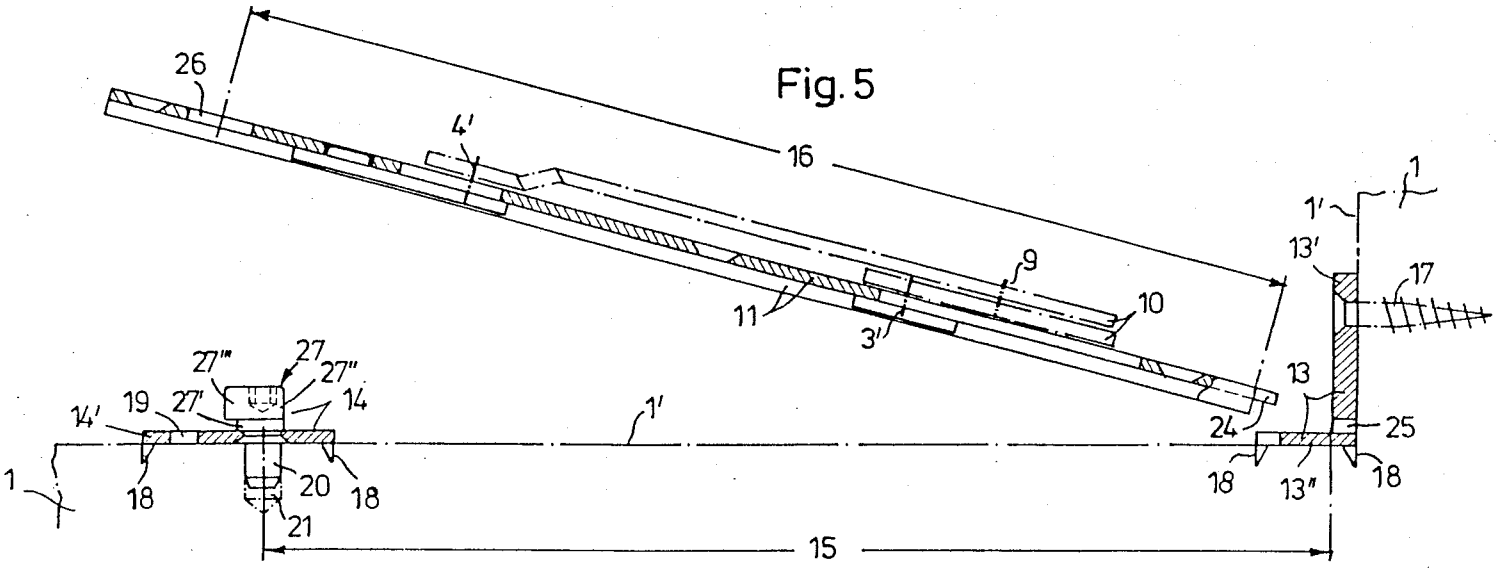
FIG. 5 is a longitudinal section of the mounting bracket of FIG. 4 showing the relative positions of its essential functional parts when the wing is hinged and unhinged with respect to the fixed frame.
Figure 6:
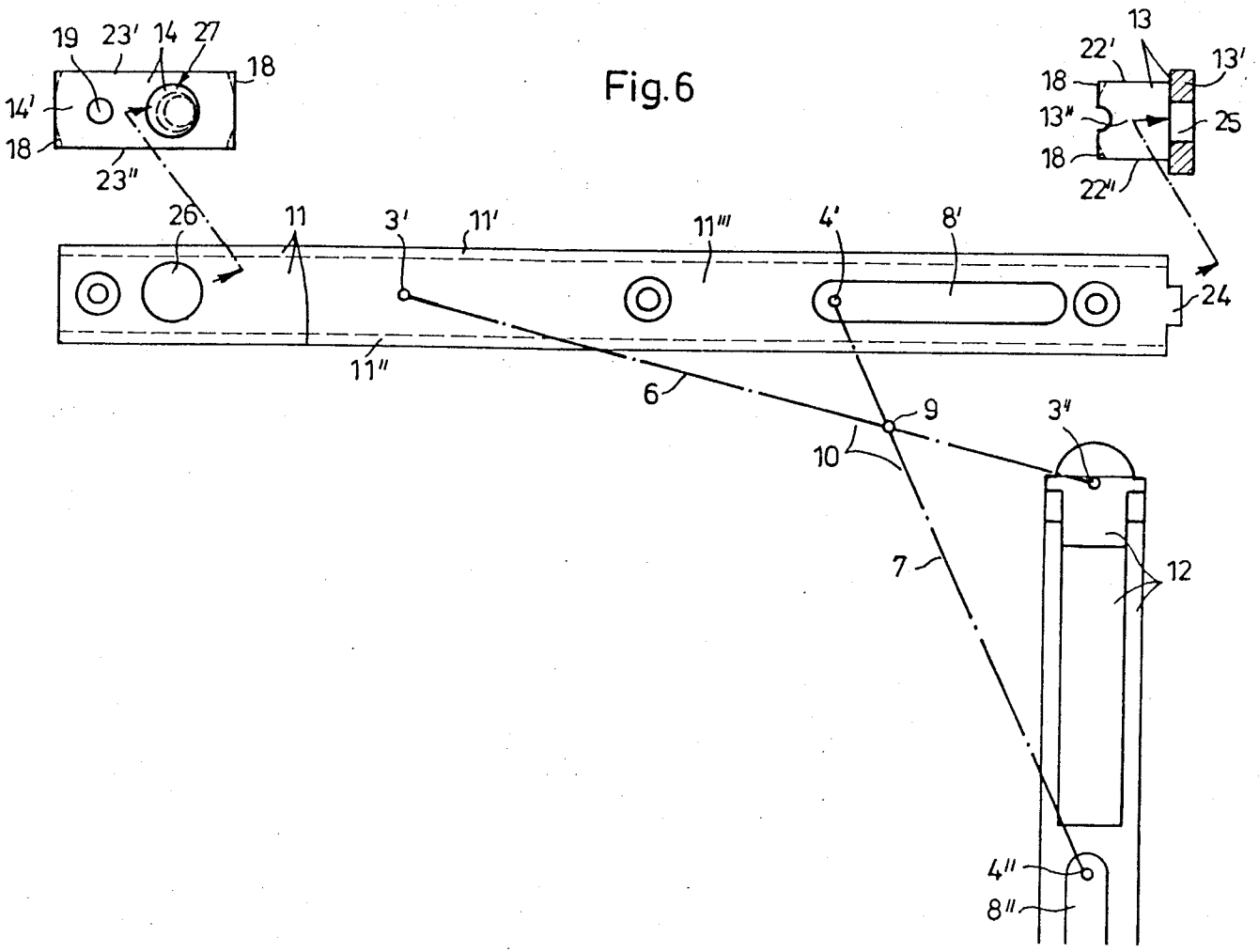
FIG. 6 is a partially schematically simplified top view of the mounting bracket during hinging or unhinging of the wing with respect to the fixed frame.

For the reasons described above, the mounting bracket 10 formed by the two guides 6 and 7 is equipped (on the one hand) with a bearing rail 11 for fastening onto the fixed frame 1 and with a holding rail 12 (on the other hand) for fastening onto the wing 2, as can be seen from FIGS. 4 through 6 of the drawing. The bearing rail 11 forms the carrier for the rotary joint 3' of the guide 6 and also contains the sliding joint 4'/8' for the guide 7.

In the case of a window or glass door with a rotary wing 2, two mounting brackets 10 which are identical but mirror images of each other in structure are installed, hidden, between the lower horizontal and the upper horizontal peripheral groove surfaces 1' and 2" of the fixed frame 1 and the wing 2, respectively. The bearing rail 11 and the horizontal peripheral groove surface 1' are adjacent to the fixed frame, while the holding rail 12 is embedded in a profiled slot on the peripheral groove surface 2' of the wing 2.

In the case of a window or glass door with a rotary/-tilting wing 2, a mounting bracket 10 is used as a rotary/tilting corner bearing between the lower horizontal peripheral groove surfaces 1' and 2' of the fixed frame 1 and wing 2, and this device is identical to the mounting bracket 10 for rotary wings. However, the mounting bracket 10 for rotary/tilting wings arranged between the upper horizontal peripheral groove surface of the fixed frame 1 and the wing 2 is arranged such that the mounting arm 5' of the rotary/tilting mounting bracket 5 on the wing side takes the place of the holding rail 12, as shown in FIG. 3 of the drawing. The rotary joint 3" of the guide 6 and the sliding joint 4"/8" for the guide 7 of the mounting bracket located there are thus installed on or in the mounting arm 5".

The same mounting brackets 10 are used for installation in windows with tipping wings or tilting wings as for windows and doors with rotary wings. In this case, however, the brackets are installed, hidden, between the vertical peripheral groove surfaces of the fixed frame 1 and wing 2.

In all of the modes for the opening of windows, doors, etc., described above, it is of considerable importance that the wing 2 be able to be hinged and unhinged with little effort and without problems, relative to the fixed frame 1, while maintaining the connection between the bearing rail 11 and the holding rail 12, (a connection which is created by the guides 6 and 7 and is dynamically appropriate).

In order to achieve this purpose, at least the bearing rail 11 of each mounting bracket 10 can be connected using a plug-type connection to bases 13 and 14 mounted on the peripheral groove surface 1' of the fixed frame 1 in a detachable and interlocking manner and can be locked against these bases 13 and 14 in contact position.

In the practical example shown in FIGS. 4 and 5 of the drawing, the two bases 13 and 14 are separated from each other. However, they must be installed at a previously determined distance 15 from each other on the peripheral groove surface 1' of the fixed frame 1 as shown in FIG. 5 of the drawing. This distance 15 is adjusted to the dimensions 16 of the bearing rail 11. This will be discussed in greater detail below.

FIGS. 4 and 5 of the drawing show that the base 13 is associated with that end of the bearing rail 11 which is closest to the sliding joint 4'/8' for the guide 7 of the mounting bracket 10. Conversely, the base 14 is associated with that end of the bearing rail 11 which is closest to the rotary joint 3' for the guide 6.

The base 13 has an angled shape, with its vertical angle leg 13, resting on the vertical peripheral groove surface 1' of the fixed frame 1, while its horizontal leg 13" is supported by the horizontal peripheral groove surface of the fixed frame 1. The base 13 is anchored on the peripheral groove surface 1' of the fixed frame 1 in part by screws 17, which penetrate the vertical angle leg 13, and in part by integral spikes 18 and/or fastening pegs (which can be drilled in) such as those found on the angle leg 13".

The base 14 has an essentially smooth base plate 14' which has at least a through hole 19 for a fastening screw and integral spikes 18 on its underside which can be driven into the peripheral groove surface 1' of the fixed frame. On the underside of the base plate 14', however, one can also see a fastening peg 20 which can be placed in an appropriate hole on the peripheral groove surface 1' of the fixed frame 1.

The bearing rail 11 shows a flattened U-shaped cross-section with two legs 11' and 11' which face the peripheral groove surface 1' of the fixed frame 1. These legs are connected to a web 11" parallel to the plane of the peripheral groove surface in the installation position.

The clearance distance between the legs 11' and 11" of the bearing rail 11 corresponds to the distance between the longitudinal edges 22' and 22" on the angle leg 13" of the base 13 and to the distance between the longitudinal edges 23' and 23" of the flat base plate 14' of the base 14. The bearing plate 11 can therefore fit around the angle leg 13" of the base 13 and the base plate 14' of the base 14 in a transverse direction.

The end of the bearing rail 11 associated with the angle leg 13' of the base 13 bears a laterally offset tongue 24 on the web 11"' which can be inserted by means of a plug connection into a correspondingly-shaped (square) opening 25 in the base 13. The opening 23 is located in the angle leg 13' of the base 13 directly adjacent to the inner corner area of the angled piece, so that the web 11"' of the bearing rail 11 rests directly on the upper side of the angle leg 13" on base 13 (see FIG. 4).

Near the end of the bearing rail 11 associated with the base 14, the rail has a contact opening 26 in its web 11"', this being an opening for a rotary toggle 27 which is intended as part of the base 14. The rotary toggle is mounted in the base plate 14' in a stiffly rotatable manner. It is provided with a collar 27' which extends beyond the upper side of the base plate 14' by the material thickness of the web 11"' of the bearing rail 11, and with a head 27' attached to it which forms a cam 27"'. The cam projects on at least one side beyond the periphery of the collar 27'.

The collar 27' of the rotary toggle 27 can also have an eccentric design with respect to the rotational axis of the toggle as a whole, with the eccentricity extending in the direction of the cam 27"'.

The distance 15 between the rotational axis of the rotary toggle 27 (which forms part of the base 14) and the inner surface of the angle leg 13' on the base 13 is adjusted to correspond to the axial distance 16 from the opening 27 in the web 11''' of the bearing rail 11 to the right end of the rail in such a manner that the head piece 27'' of the rotary toggle 27 can protrude through the opening 26 as shown in FIG. 5, after the tongue 24 of the bearing rail 11 has been inserted in the opening 25 on the base 13. The insertion of the tongue 24 in the opening 25 can be carried out with a slanted position of the bearing rail 11. This is shown to an exaggerated degree in FIG. 5 of the drawing for purposes of clarity. In practice, however, this slanted position need only be such that the left end of the bearing rail 11 is close to the head 27'' of the rotary toggle 27, clearing it by only a small margin.

After the rotary toggle 27 has penetrated the opening 26 with its head piece 27'' and when its collar 27' is located in the area of the opening 26, the rotary toggle 27 can be turned by 180° as shown in FIG. 4. The cam 27'' then overlaps by its head piece 27''' at the right edge area of the opening 26 in the web 11' of the bearing rail 11, thus preventing the rail from rising up off the base 14. In the case of an eccentric arrangement of the collar 27' with respect to the radial axis of the rotary toggle 27', it is also possible to exert a certain degree of lateral pressure to the right against the edge of the hole in the opening 26, resulting in a bracing of the bearing rail 11 against the angle leg 13' of the base 13. This secures the penetration of the tongue 24 into the opening 25.

It is apparent that the mounting bracket 10 can be attached via its bearing rail 11 in a simple but secure manner to the bases 13 and 14 on the peripheral groove surface 1' of the fixed frame, thus guaranteeing problem-free hinging and unhinging of the wing 2 relative to the fixed frame.

Of course, it would also be possible to use an adjustable latch, instead of the latch device consisting of the rotary toggle 27 on the base 14 and the opening 26 in the bearing rail 11. The adjustable latch would have other functional parts, such as a spring-loaded catch on the bearing rail 11 which would operate automatically from the base and could then be released only using a special tool.

Figure 7:
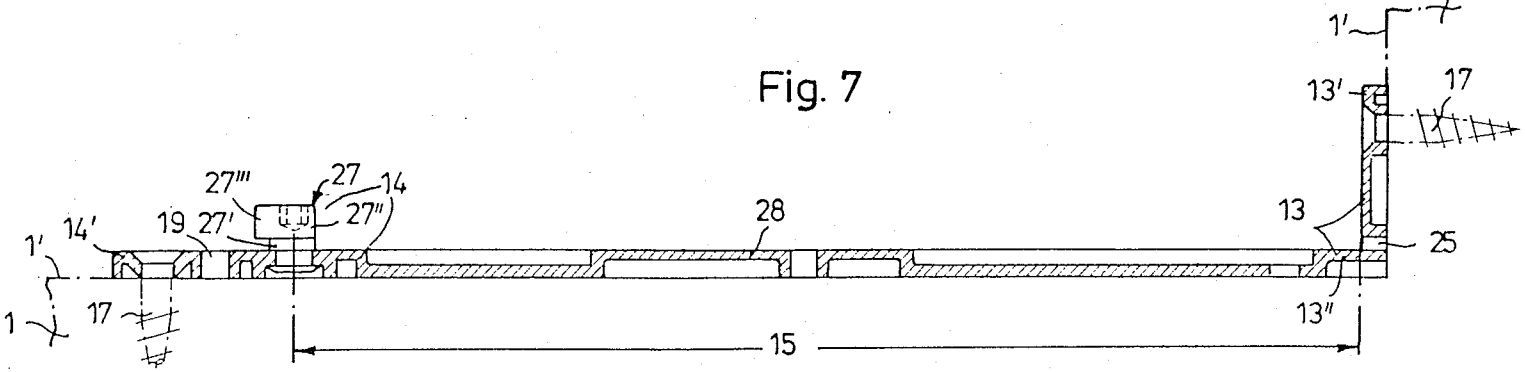
FIG. 7 is a view corresponding to FIG. 5 of a preferable embodiment in the functional components of the mounting bracket.

FIG. 7 of the drawing shows that the two bases 13 and 14 can be connected by a transition piece at a predetermined distance, preferably integral with the bases. The bases 13 and 14 and the intermediate piece 28 can be manufactured from sheet metal material as stamped or bent, preformed parts or they can be manufactured as pressure- or injection-molded preformed parts of metal such as zinc or brass alloys. In the latter case, the cross-sectional form of the bases 13 and 14 and of the transition piece 28 can be adjusted to the various shapes of the peripheral groove surface 1' of the fixed frame 1 which are employed when the frame is manufactured using plastic or metal profiles.

It has proved to be particularly effective to connect not only the bases 13 and 14 and the transition piece 28 but also the bearing rail to the fixed frame 1 using screws 29, and these screws 29 can also be used to connect the bases 3 and 14 with the bearing rail 11.

Of course, it is also within the scope of the design of the mounting bracket 10 of the present invention to fasten the holding rail 12 on the wing 2 in a detachable manner, either instead of the bearing rail 11 or in addition to it, by means of similar base parts, such as those described above for use on the fixed frame 1. The bases to be fastened to the wing 2 could then be placed in a lower, narrower cross-sectional part of a step-slot on the groove surface, while the bearing rail 12 is taken up flush with an outer, wider slot cross-section.

In all of the modes for the opening of windows, doors, etc., described above, it is of considerable importance that the position of the wing 2 can be adjustable with little effort and without problems, relative to the frame 1. This adjustment of the position of the wing 2 with respect to the frame 1 is necessary in carrying out shim work and/or first-time installation of the windows and doors in a building. It must also be possible thereafter at any time in order to compensate for or eliminate changes in position of the wing 2 such as with respect to the frame, which are inevitable in practice.

Figure 8:
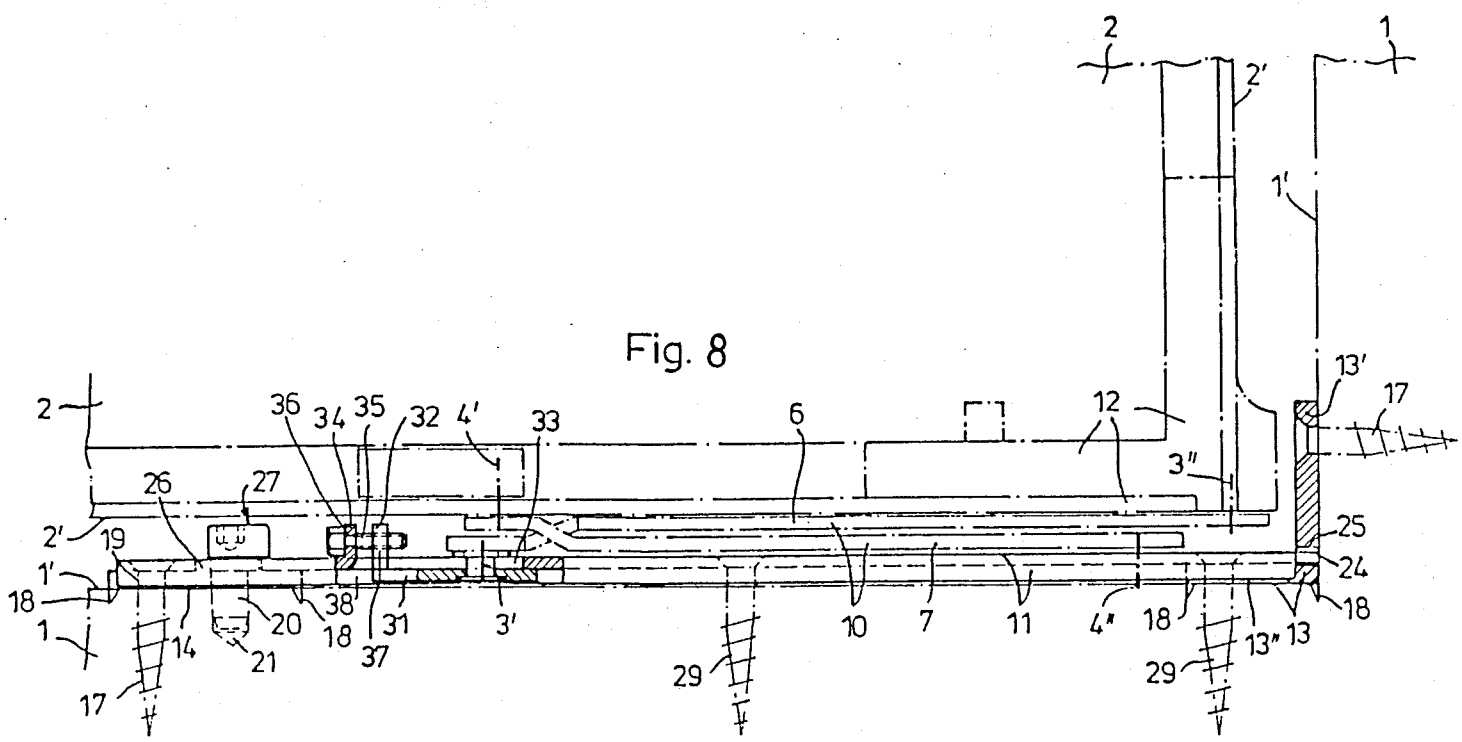
FIG. 8 is a front view and a partial vertical section of preliminary design of a mounting bracket, used in wings which close onto the frame, which is installed as a rotary/tilting corner bearing in rotary tilting windows or doors or as a hinge for rotary wing windows.
Figure 9:
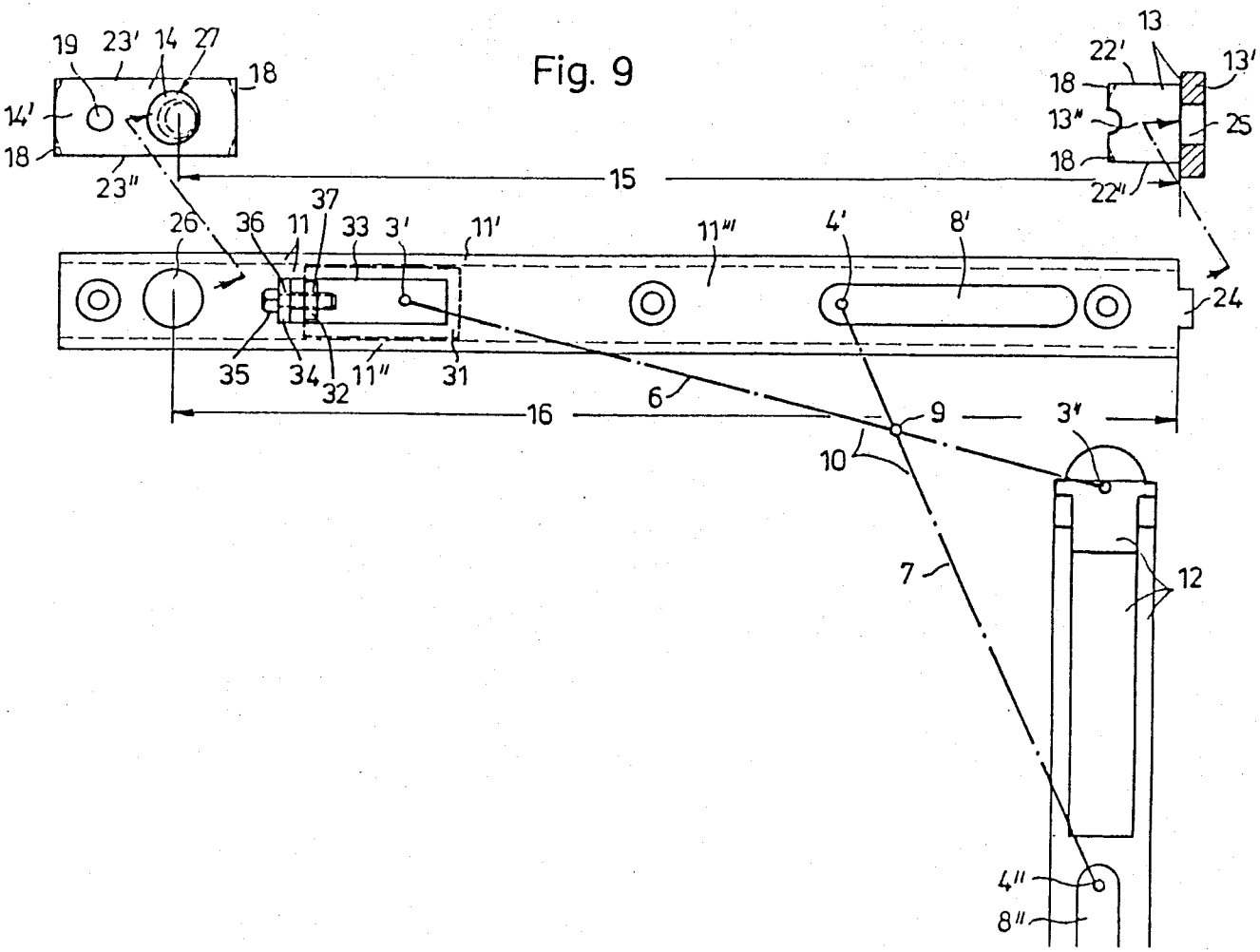
FIG. 9 is a partially schematically simplified top view of the mounting bracket of FIG. 8 with its wing opened in a rotary position.

For this purpose, in the case of the mounting bracket device 10 shown in FIGS. 8 and 9, the joint 3' of the guide 6 is placed on a slide 31, which fits into the bearing rail 11 in such a way that it can be moved longitudinally to a limited extent, and has a roughly U-shaped cross-section. Both the joint 3' for the guide 6 and the angled flange 32 of the slide 31 protrude through a longitudinal slit 33 in the holding rail 11 in such a manner that the flange 32 is adjacent to the end of the guide 6 incorporating the joint 3'.

A second angled flange 34 is also connected to the end of the longitudinal slit 33 which is separated from the holding rail in the same direction as the flange 32. A threaded element, such as a bolt 35, is placed in a hole 36 in the flange 34 in such a manner that it can be turned, but preferably not displaced, and permanently fits into a counterthread 37 in the flange 32 of the slide 31.

By turning the thread element or bolt 35 it is possible to forcibly shift the slide 31 longitudinally relative to the bearing rail 11 such that the joint 3' for the guide 6 of the mounting bracket 10 undergoes a corresponding forced shift relative to the bearing rail 11.

While the bearing rail 11 itself is fastened to the peripheral surface of the groove 1' of the frame in a stiff and immobile manner using several fastening screws 17 and 29, the position of the arms of the mounting bracket 10, and with them the wing 2, may be adjusted parallel to the surface of the frame 1 by actuating the thread element or bolt 35 using an appropriate adjusting tool (screwdriver or wrench).

The longitudinal slit 8' in the holding rail, which is an essential functional part of the sliding joint 4'/8' for the guide 7, should preferably be longer (along the possible path of adjustment of the slide 31) than the effective length which would be required for the displacement of the joint peg 4' located on the guide 7. Under these circumstances, the slide 31 can be extended out from the rotary joint 3' for the guide 6 within the holding rail so far that it protrudes into the area of the longitudinal slit 8'. Its free end, in all positions, then forms a support for the joint 4' of the guide when the mounting bracket 10 is rotated open.

Figure 10:
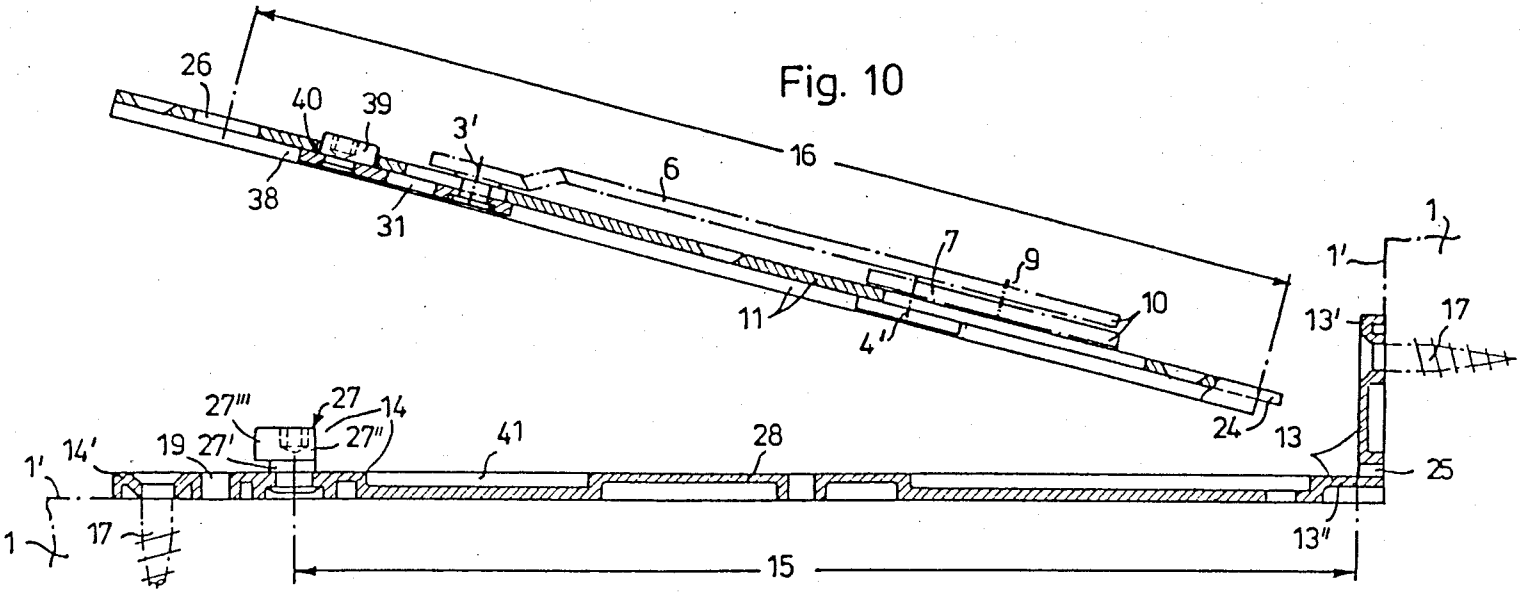
FIG. 10 is a partially schematically simplified depiction of another embodiment of the mounting bracket.
Figure 11:
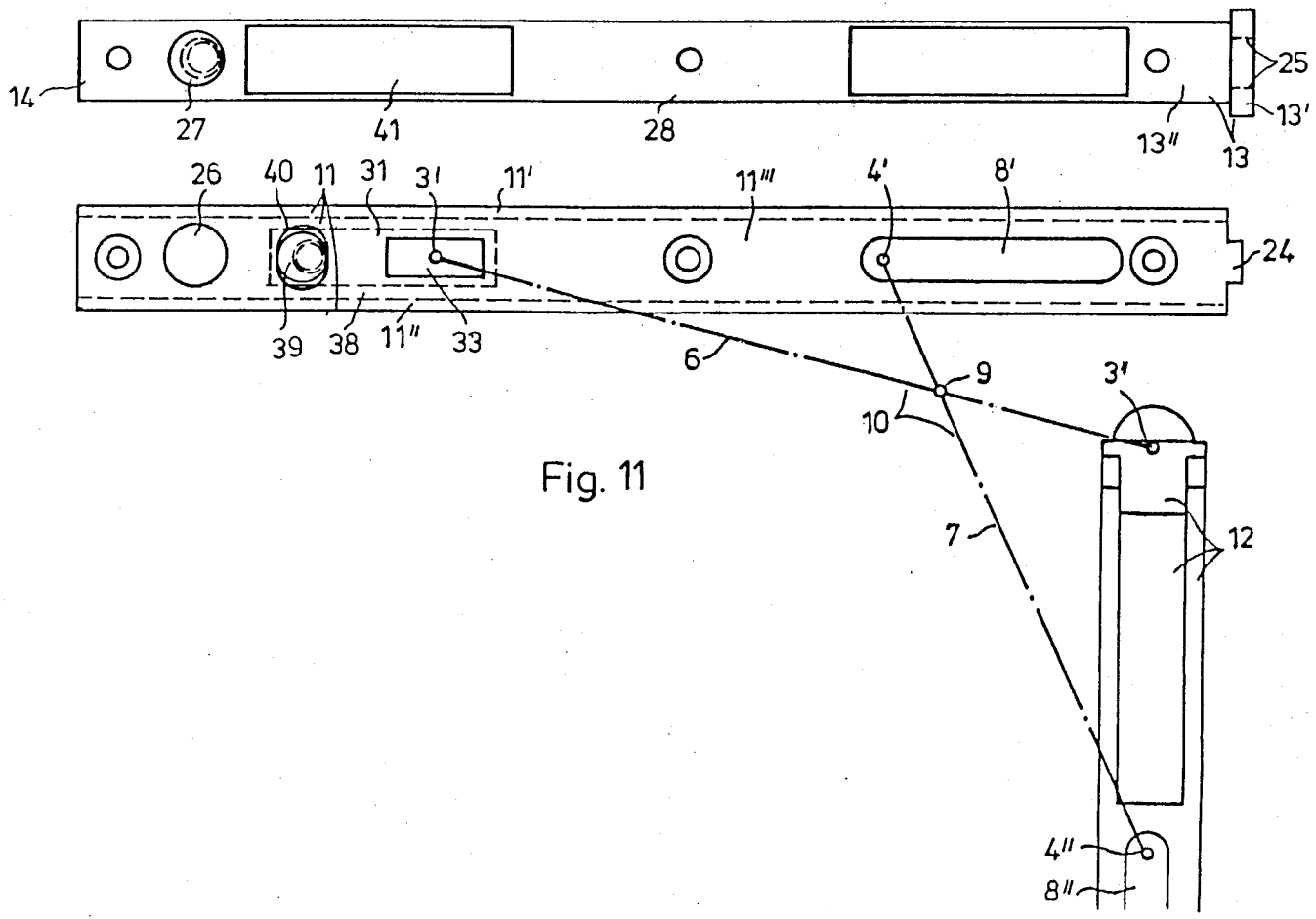
FIG. 11 shows the mounting bracket of FIG. 10 in a top view and with the wing opened in a rotary position.

The practical example shown in FIGS. 10 and 11 of the drawing of a mounting bracket 10 differs from that shown in FIGS. 7 and 8 in that the slide 31 which moves longitudinally in the holding rail 11 is provided with a cam 39 as an adjustment member which can be stiffly rotated on its upper side, with the cam permanently fitting into an oblong hole 40 which is positioned in a transverse direction to the holding rail 11.

By rotating the cam 39 using a screwdriver or socket wrench, for example, it is possible to carry out sensitive and form-fitting adjustment of position of the joint 3' for the guide 6 and thus of the entire mounting bracket 10 relative to the fixed holding rail 11 on the frame, and without requiring the fastening screws 17 and 29 to be loosened.

It should be mentioned that it is also possible to design the joint 3" between the guide 6 and the bearing rail 12 of the mounting bracket mounted on the wing 2 such that it can be longitudinally adjusted in a similar manner to that described for joint 3' on the holding rail 11 in FIGS. 7, 8, 9 and 10.

If both joints 3' and 3" are equipped with corresponding adjustment devices, it is possible to accommodate a relatively large adjustment path for the purpose of adjustment of the position of the wing 2 with respect to the frame 1 parallel to its plane, even with limited installation space.

The slide 31 for the joint 3' is installed in a free space 38 of the bearing rail 11 which is separated from the attachment sites 17, 18, 20, and 21 for the base 14. In particular, if the bases 13 and 14 are connected by a transition piece 28, the free space 38 of the bearing rail 11 can also correspond to a free space 41 in base 14 and/or in transition piece 28.

In another embodiment (FIG. 12), the mounting bracket 50 formed by the two guides 6 and 7 is again equipped with a bearing rail 51 for attachment to the frame 1 and with a holding rail 52 for attachment to the wing 2.

The bearing rail 51 forms both the carrier for the rotary joint 3' for the guide 6 and contains the sliding joint 4'/8' for the guide 7. In contrast, the holding rail 52 has the rotary joint 3" for the guide 6 and is also equipped with the sliding joint 4"/8" for the guide 7.

In the case of a window or glass door with a rotary wing, two mounting brackets 50 which are congruent but mirror images of each other in terms of design are installed, hidden, between the upper horizontal peripheral groove surface and the wing 2. The bearing rail 51 and the horizontal peripheral groove surface are adjacent to the fixed frame, while the holding rail 52 is embedded in a profiled slot on the peripheral groove surface 2' of the wing 2.

In the case of a window or glass door with a rotary/-tilting wing 2, a mounting bracket 50 is used as a rotary/tilting corner bearing between the lower horizontal peripheral groove surfaces of the groove of the frame 1 and wing 2, and this device is identical to the mounting bracket 50 for rotary wings. However, the mounting bracket 50 for rotary/tilting wings installed between the upper horizontal peripheral surface groove of the fixed frame 1 and the wing 2 is arranged so that the mounting arm 5' of the rotary/tilting mounting bracket 5 on the wing side takes the place of the holding rail 52 which would otherwise have been on the wing side, as shown in FIG. 3 of the drawing. The rotary joint 3" of the guide 6 and the sliding joint 4"/5" for the guide 7 of the mounting bracket located there are thus installed on the mounting arm 5'.

The same mounting brackets 50 are used for installation in windows with tipping wings or tilting wings as for windows and doors with rotary wings. In such cases, however, the devices are installed, hidden, between the vertical peripheral groove surfaces of fixed frames 1 and wing 2.

In all of the modes of opening of windows, doors, etc., described above, it is of considerable importance that the wing 2 can be precisely adjusted, with minimal effort and without problems, relative to the frame 1. This adjustment of the wing 2 with respect to the frame 1 is necessary not only in carrying out shim work and-/or in the first-time installation of the windows and doors in a building. It must also be possible thereafter at any time in order to compensate for or eliminate changes in position of the wing 2 such as settling with respect to the frame, which are inevitable in practice.

Figure 12:
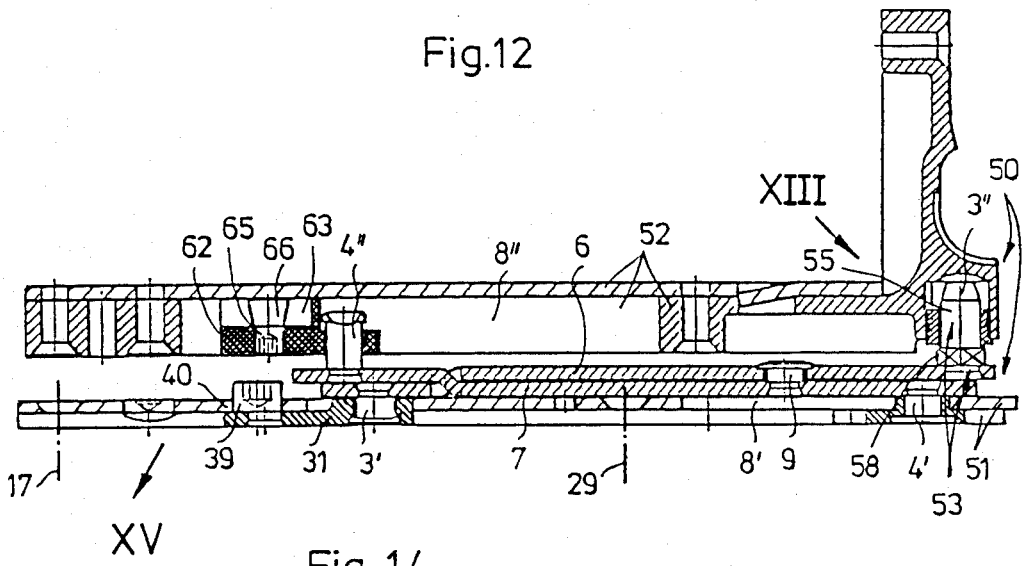
FIG. 12 is a vertical section of a mounting bracket, with the wing closed onto the frame, installed as a rotary/tilting corner bearing in rotary/tilting windows or doors or as a hinge for rotary wing windows.
Figure 14:
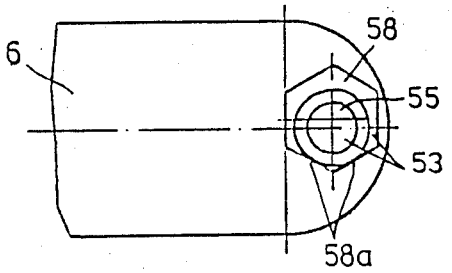
FIG. 14 is a vertical view of the joint, which is essential to the innovation, of the mounting bracket shown in FIGS. 12 and 13.

For this purpose, in the case of the mounting bracket 50 shown in FIG. 12, the joint 3' of the guide 6 is placed on a slide 31, which fits into the bearing rail 51 in such a way that it can be moved longitudinally to a limited extent, and has a roughly U-shaped cross-section.

A cam 39 serves as an adjustment member for the slide 31 relative to the bearing rail 51, and sits on the slide so that it can be stiffly rotated. The cam permanently fits into an oblong hole 40 which is positioned in a transverse direction to the holding rail 51.

By rotating the cam 39 using a screwdriver or socket wrench, for example, it is possible to carry out sensitive and form-fitting adjustment of the joint 3' for the guide 6 and thus of the entire mounting bracket 50 relative to the fixed holding rail 51 on the frame, and without requiring the fastening screws 17 and 29 to be loosened.

It is also possible to connect the guide 6 of the mounting bracket 50, which is positioned such that it can otherwise only be moved in a pivoting manner, along with its second joint 3", with the holding rail 52 on the wing side in such a way that it can be adjusted in a transverse direction to a limited extent. Thus, if necessary, the sealing pressure between the wing 2 and the frame 1 can be varied with the window or glass door closed. For this purpose, a cam peg 53 is used to form the joint 3", with this peg being connected to the guide 6 such that it can be stiffly rotated. For example, it may be connected to the guide at 54 by press-fitting or riveting. This cam peg fits into its shaft 55 in a bearing bush 56 in a detachable manner, and this bearing bush is located in a hollow 57 in the bearing 52 such that it cannot be rotated.

The cam peg 53 has a band 58 below the bearing bush 56 which has tool contact surfaces **58*a* for a tool such as a wrench on its periphery. Using a wrench, the eccentricity of the cam peg 53 on the guide 6 can be adjusted in a sensitive manner, thus regulating the pressure of the wing 2 against the frame 1** correspondingly.

When the cam peg 53 is activated in order to adjust the bearing rail 52 and with it the wing 2 in a transverse position, this eccentricity results in a shift in position of the bearing rail 52 with respect to the wing 2. This undesired shift in the wing, however, can easily be compensated for using the other cam 39 which fits into the bearing rail 51.

Figure 13:
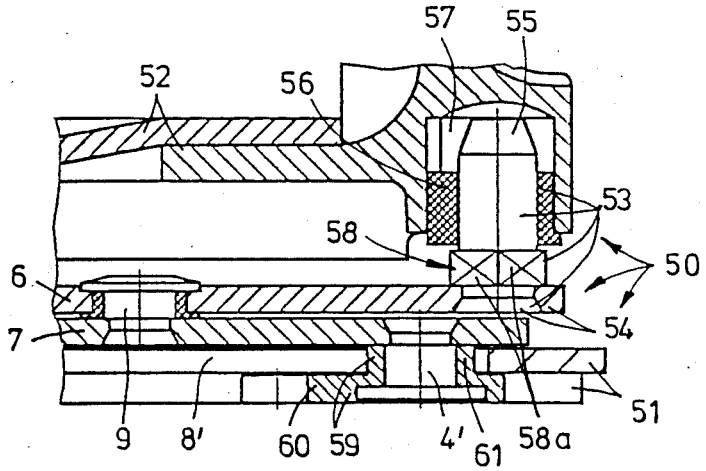
FIG. 13 is an expanded view of the cutout area marked XIII in FIG. 12.
Figure 15:
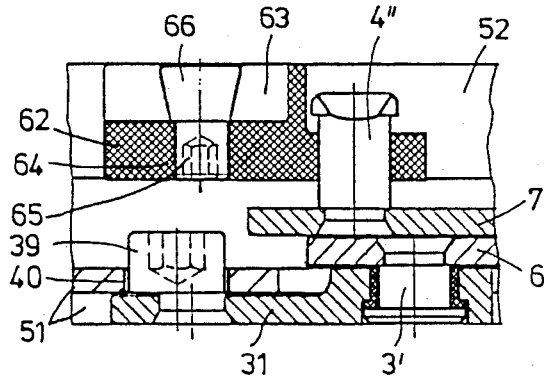
FIG. 15 is an expanded view of the cutout area marked XV in FIG. 12.

Additional design features of the mounting bracket 50 should be pointed out here. As shown in FIGS. 12 and 13, the sliding joint 4'/8' on bearing rail 51 fits around a slide 59 which is made of a material which is resistant to abrasion and breakage and which contains the joint peg 4'. The slide 59 rests in a stable manner with its essentially rectangular foot piece 60 within the free U-shaped cross-section of the bearing rail 51. Its collar piece 61 protrudes up into the longitudinal slit 8' of the bearing rail 51.

The joint peg 4" of the sliding joint 4"/8" on the holding rail 52 also operates together with a slide 62 which is made from a material which is resistant to breakage but elastically workable, such as hard plastic. In some areas, this slide 62 has a U-shaped cross-section which is open to the top, with the inner limiting surfaces of the opening area 63 being shaped in a roughly trapezoidal manner. The web of the slide 62 contains a slide element 62 which can be adjusted using a thread element 64, and this member has a head piece 66 which diverges in a conical shape from bottom to top. When the screw member 65 in the screw 64 is axially shifted, the slide element 62 is opened to a greater or lesser degree by means of the head piece 66 located in the opening area 63, so that it forms a friction brake against the longitudinal walls of the sliding slit 8'' in the holding rail 52. Using this friction brake, the degree of opening movement of the wing 2 in relation to the frame 1 can be regulated.

The adjusting screw 65 can be easily reached with a wrench when the wing 2 is opened.

Clearly, minor changes may be made in the form and construction of this invention without departing from the material spirit thereof. Therefore, it is not desired to confine the invention to the exact forms shown herein and described but it is desired to include all subject matter that properly comes within the scope claimed.

The invention having been thus described, what is claimed as new and desired to secure by Letters Patent is:

1. A mounting bracket (10) for the wings (2) of windows, doors, and the like, consisting of a bearing rail (11) secured in a groove surface (1') on a fixed frame side and a holding rail (12) on a groove surface of a wing, and two guides (6 and 7), each of which is connected at one end to the bearing rail (11) and at the other end to the holding rail (12) in a manner which allows a swiveling motion at the joints (3'; 4'/8' or 3''; 4''/8'') formed by each connection, characterized by the fact that the bearing rail (11) is connected to the frame by a plug-type connection (24, 25 and 26, 27) to bases (13 and 14) mounted on the peripheral groove surface (1') of the fixed frame (1) by a detachable and interlocking structure by means of a reversible lock (26, 27''') which holds the rail against these bases (13 and 14) in a contact position.

2. The mounting bracket of claim 1, characterized by the fact that one end of the bearing rail (11) is fastened to a base (13 or 14) mounted on the groove surface (1') of the fixed frame (1).

3. The mounting bracket of claim 1, characterized by the fact that one (13) of the bases has an angled shape with two angle legs and is mounted in a corner area of the peripheral groove surface of the frame (1'), with one angle leg (13' or 13'') each adjacent to one frame leg.

4. The mounting bracket of claim 1, characterized by the fact that the bases have longitudinal edges, the bearing rail (11) has a flat U-shaped cross-section and fits around the longitudinal edges (22', 22'' or 23', 23'') of the bases with U-legs formed thereon, by the fact that the one end of the bearing rail (11) has a laterally offset tongue (24) adapted to be engaged in a corresponding opening (25) in one of the bases (13), and by the fact that the bearing rail (11) has means to be secured to the other base (14) adjacent its other end the means comprising an adjustable latch (26, 27).

5. The mounting bracket of claim 4, characterized by the fact that, the adjustable latch (26, 27) comprises a rotating toggle (27) which can be stiffly moved on one of said bases (14) and a corresponding contact opening (26) in a web (11''') of the bearing rail (11).

6. The mounting bracket of claim 1, characterized by the fact that, the two bases (13 and 14) are connected by a transition piece (28) at a predetermined distance (15).

7. The mounting bracket of claim 1, characterized by the fact that the bases (13 and 14) and the bearing rail (11) are attached to the fixed frame (1) and also to each other by threaded fasteners (29).

8. The mounting bracket of claim 1, wherein a first (6) of the two guides (6 and 7) is attached to both the holding rail (12) and the bearing rail (11) by pivoting joints (3' or 3'') while the second guide (7) is attached to both the holding rail (12) and the bearing rail (11) with pivoting and sliding joints, characterized by the fact that the first guide is provided with at least one joint (3') on a slide (31) which is secured against the rail by an adjusting member (35 or 39) so that it can be longitudinally displaced to a limited extent (32, 34, or 40).

9. The mounting bracket of claim 8, characterized by the fact that, the adjusting member is chosen from the group consisting of: (a.) threaded element (35) which is secured against the bearing rail (11), so that it can be rotated but not displaced (34, 36) and which fits into a counterthread (37) located in the slide (31); and (b.) a cam (39) which is located in the slide (31), so that it can be stiffly rotated, and which permanently fits into an oblong hole (40) located in the bearing rail (11), the hole positioned in a transverse direction to the direction of movement of the slide (31).

10. The mounting bracket of claim 8, characterized by the fact that, the slide (31) is located in a free space (38) separated from the attachment sites (17, 18, 20, 21) of the first base (14) and the bearing rail (11), with a free space (41) in the base (14) aligned and continuous with the free space (38) in the bearing rail (11) and the slide (31) being enclosed in both free spaces.

11. The mounting bracket of claim 8, characterized by the fact that, the first guide (6) is provided with joints at the holding rail (52) or bearing rail (51) which can be transversely adjusted to a limited extent.

12. The mounting bracket of claim 8, characterized by the fact that, a joint (3'') of the first guide comprises a cam peg (53) which is connected to the guide (6) in a stiffly rotatable manner and is connected using a plug-type connection to a bearing bush (56) of the bearing rail (52), with the cam peg (53) having a band (58) below the bearing bush 56 which has tool contact surfaces (**58*a*) for tools such as wrenches on its periphery, and with the cam peg (53) being press-fit or riveted (54) to the guide (6**).

* * * * *